US008419278B2

(12) United States Patent
Tanaka

(10) Patent No.: US 8,419,278 B2
(45) Date of Patent: Apr. 16, 2013

(54) CHECK VALVE AND COMPRESSION BAG AND AIR CUSHION BAG EQUIPPED THEREWITH

(75) Inventor: Kazuya Tanaka, Kashihara (JP)

(73) Assignee: Mikio Tanaka, Tenri-Shi Nara (JP)

( * ) Notice: Subject to any disclaimer, the term of this patent is extended or adjusted under 35 U.S.C. 154(b) by 357 days.

(21) Appl. No.: 12/719,722

(22) Filed: Mar. 8, 2010

(65) Prior Publication Data

US 2010/0183248 A1 Jul. 22, 2010

Related U.S. Application Data

(63) Continuation-in-part of application No. 10/571,899, filed as application No. PCT/JP2005/016089 on Sep. 2, 2005, now Pat. No. 7,708,464.

(51) Int. Cl.

| | |
|---|---|
| ***B65D 30/24*** | (2006.01) |
| ***B65D 30/00*** | (2006.01) |
| ***B65D 30/01*** | (2006.01) |
| ***B65D 81/02*** | (2006.01) |
| ***B65D 81/20*** | (2006.01) |
| ***F16K 15/20*** | (2006.01) |

(52) U.S. Cl.
USPC ..... 383/44; 383/3; 383/48; 383/100; 383/101; 206/522; 206/524.8; 137/223

(58) Field of Classification Search ..... 383/3, 44, 383/48, 100, 101; 206/522, 524.8; 137/223
See application file for complete search history.

(56) References Cited

U.S. PATENT DOCUMENTS

| | | | | |
|---|---|---|---|---|
| 2,799,314 | A | | 7/1957 | Dreyer et al. |
| 2,800,269 | A | | 7/1957 | Smith |
| 3,263,903 | A | | 8/1966 | Waller et al. |
| 3,343,463 | A | | 9/1967 | Kurt et al. |
| 3,806,025 | A | | 4/1974 | Marshall |
| 4,834,554 | A | | 5/1989 | Stetler et al. |
| 4,865,464 | A | | 9/1989 | Enzu |
| 4,983,138 | A | * | 1/1991 | McGrath ..... 446/224 |
| 5,540,500 | A | | 7/1996 | Tanaka |
| 5,701,996 | A | | 12/1997 | Goto et al. |
| 5,755,328 | A | * | 5/1998 | DeLuca ..... 206/522 |

(Continued)

FOREIGN PATENT DOCUMENTS

| | | | |
|---|---|---|---|
| JP | 58-112955 | A | 7/1983 |
| JP | 6-697 | Y2 | 1/1994 |

(Continued)

*Primary Examiner* — Jes F Pascua
(74) *Attorney, Agent, or Firm* — Birch, Stewart, Kolasch and Birch, LLP

(57) ABSTRACT

A check valve includes two valve films of synthetic resin that put one on the other, and an air passage defined by two seal sections formed by means of bonding parts of the valve films together. A compression bag and air compression bag equipped with this check valve are also provided. An inlet of the air passage is defined by a straight line linking the respective upward flow side end sections of the seal sections. An outlet of the air passage is defined by a straight line linking the respective downward flow side end sections of the seal sections. In at least one of the seal sections, the valve films are not bonded together at the line of extension of the seal section, situated on the downward flow side of the downward flow side end section of the seal section.

15 Claims, 11 Drawing Sheets

U.S. PATENT DOCUMENTS

| | | | | |
|---|---|---|---|---|
| 6,499,600 | B2 | 12/2002 | Koyanagi | |
| 6,622,857 | B2 | 9/2003 | Ohtsubo et al. | |
| 7,448,803 | B2 | 11/2008 | Ootsubo | |
| 7,482,051 | B2 * | 1/2009 | Tanaka et al. | 428/178 |
| 7,708,464 | B2 * | 5/2010 | Tanaka | 383/100 |
| 2002/0044702 | A1 | 4/2002 | Koyanagi | |
| 2004/0057636 | A1 | 3/2004 | Ishizaki | |
| 2010/0096290 | A1 * | 4/2010 | Frayne et al. | 206/522 |
| 2010/0101970 | A1 * | 4/2010 | Frayne et al. | 206/522 |

FOREIGN PATENT DOCUMENTS

| | | | | |
|---|---|---|---|---|
| JP | 07052958 | A | * | 2/1995 |
| JP | 09086565 | A | * | 3/1997 |
| JP | 9-290840 | A | | 11/1997 |
| JP | -9-310770 | A | | 12/1997 |
| JP | 09310770 | A | * | 12/1997 |
| JP | 10-706 | A | | 1/1998 |
| JP | 2002255192 | A | * | 9/2002 |
| WO | WO 9823492 | A1 | * | 6/1998 |

* cited by examiner

CHECK VALVE AND COMPRESSION BAG AND AIR CUSHION BAG EQUIPPED THEREWITH

This application is a Continuation-In-Part Application of U.S. application Ser. No. 10/571,899 filed on Mar. 14, 2006, now U.S. Pat. No. 7,708,464, which is the National Phase of PCT International Application No. PCT/JP2005/016089 filed on Sep. 2, 2005, the entire contents of all are hereby incorporated by reference.

FIELD OF THE INVENTION

The present invention relates to a check valve using two valve films made of synthetic resin, which is able to pass an air flow in one direction, and to a compression bag and air cushion bag equipped with this check valve.

BACKGROUND ART

Patent Reference No. 1: JP utility model application laid-open No. H06-697

Conventionally, compression bags are known in which an item for storage which is bulky as a result of containing air, such as clothing, bedding or the like, is contained, and then compressed by expelling the air contained therein, in such a manner that the item can be stored in a compact fashion. Further, bags (air cushion bags) are also known which are filled with air and can maintain an inflated state. The compression bag is provided with an opening for introducing and removing the item for storage, and this opening can be closed to seal off the interior of the bag hermetically, by means of a zip fastener or the like. Many compression bags are provided with deaeration valves having an air passage for expelling air from the interior of the bag. On the other hand, the air cushion bag is provided with a check valve having an air passage for injecting air into the interior of the bag.

There are check valves having a composition in which two valve films made of synthetic resin are superimposed on each other. In these valves, rectangular valve films are used, and an air passage is provided by seal sections formed by bonding the longitudinal side edges of the valve films together, and air is allowed to pass through the two valve films from an inlet to an outlet, and the air passage is closable by the two valve films that closely contact together.

This check valve has a simple structure, but there are drawbacks in slackening of the valve films and inverse flow of air. One of the reasons for this slackening is thought to be local instability in the tension of the valve films which occurs as a result of the fixed positional relation between the films in the aforementioned seal sections.

On the other hand, in one example of a device aimed at preventing inverse flow in a check valve having the aforementioned structure, the patent reference No. 1 proposes bending of the air passage. However, although this check valve makes it less liable for inverse flow to occur, it does not resolve the aforementioned problem, namely, the fact that the valve films are fixed together in the seal sections, thereby producing local instabilities in the tension of the valve films.

In view of the circumstances, it is an object of the present invention to provide a check valve, and a compression bag and an air cushion bag equipped with a check valve, whereby the tension of the valve film can be stabilized, and inverse flow of air can be prevented effectively in spite of a simple structure.

DISCLOSURE OF THE INVENTION

In order to achieve the aforementioned object, a first aspect of the present invention provides a check valve 1 comprising two films 11, 12 of synthetic resin that are placed one on the other and bonded at parts thereof together. An air passage 2 is formed that allows to pass air through the valve films from an inlet 2*a* to an outlet 2*b* and closable by means of the valve films 11, 12 that closely contact together. The air passage 2 is defined by two seal sections 21, 22, which are formed by bonding the valve films 11, 12 together. The inlet 2*a* of the air passage 2 is defined by a straight line linking respective upward flow side end sections 21*a*, 221*a* of the seal sections 21, 22, while the outlet 2*b* of the air passage 2 is defined by a straight line linking respective downward flow side end sections 21*b*, 223*b* of the seal sections 21, 22. At least one of the downward flow side end sections 21*b*, 223*b* of the seal sections 21, 22 and downward flow side edges 11*b*, 12*b* of the valve films 11, 12 are separated. A passage extension section 31 is provided on the downward flow side of the air passage 2, and is defined by the outlet 2*b* of the air passage 2, the downward flow side edges 11*b*, 12*b* of the valve films 11, 12, and a virtual line 21*c*, 223*c*. The virtual line 21*c*, 223*c* links the downward flow side end section 21*b*, 223*b* of at least one of the seal sections 21, 22 and the downward flow side edges 11*b*, 12*b* of the valve films 11, 12, and at the virtual line 21*c*, 223*c*, the valve films 11, 12 are not bonded together, and air in the air passage 2 flows out of the valve films 11, 12 through the passage extension section 31 from the outlet 2*b*.

A second aspect of the present invention provides the check valve 1 according to the first aspect of the present invention, wherein the virtual line 21*c*, 223*c* is a line of extension 21*c*, 223*c* where at least one of the seal sections (21, 22) is extended toward the downward flow side edges 11*b*, 12*b* of the valve films 11, 12.

A third aspect of the present invention provides the check valve 1 according to the second aspect of the present invention, which further comprises a non-sealed section 3 comprising the passage extension section 31 and a free section 32. The free section 32 is adjacent to the passage extension section 31 or to the air passage 2 and the passage extension section 31. The passage extension section 31 and the free section 32 are bounded by the line of extension 21*c*, 223*c* that defines the passage extension section 31. The portions of valve film 11, 12 constituting the passage extension section 31 and the free section 32 form a single body.

A fourth aspect of the present invention provides the check valve 1 according to the first or second aspect of the present invention, wherein a slit 14 is formed in each of the two valve films 11, 12, the slit 14 following the air passage 2 and the passage extension section 31, and being formed in such a manner that the downward flow side edges 11*b*, 12*b* of the valve films 11, 12 are divided.

A fifth aspect of the present invention provides the check valve 1 according to the first or second aspect of the present invention, wherein the dimension L2*b* between the respective end sections of the first side seal section 21 and the second side seal section 22 at the outlet of the air passage 2 is smaller than the dimension L2*a* between the respective end sections at the inlet of the air passage 2.

A sixth aspect of the present invention provides the check valve according to the third aspect of the present invention, wherein the first side seal section 21 has a linear form, and the second side seal section 22 comprises three sections that are an introduction section 221, an intermediate section 222, and an expulsion section 223. The intermediate section 222 connects between the introduction section 221 and the expulsion section 223. Regarding the second side seal section 22, the intermediate section 222 is formed closer to the first side seal section 21 than the introduction section 221, and the expulsion section 223 is formed closer to the first side seal section 21 than the intermediate section 222. The inlet 2*a* of the air passage 2 is defined by the upward flow side end section 221*a* of the introduction section 221 and the upward flow side end section 21*a* of the first side seal section 21, while the outlet 2*b* of the air passage 2 is formed by the downward flow side end section 223*b* of the introduction section 223 and the downward flow side end section 21*b* of the first side seal section 21. The downward flow side end section 223*b* of the second side seal section 22 is formed further towards the upward flow side than the downward flow side end section 21*b* of the first side seal section 21. The free section 32 being formed adjacent to the air passage 2 and the passage extension section 31 is provided.

A seventh aspect of the present invention provides the check valve according to the first or second aspect of the present invention, wherein, in the air passage 2, the upward flow side edge 11*a*, 12*a* of the valve films 11, 12 that are placed one on the other, and the upward flow side edge 12*a*, 11*a* of the other of the valve films 12, 11 are disposed at least respectively in staggered positions towards the upward flow side and the downward flow side.

An eighth aspect of the present invention provides the check valve according to the first or second aspect of the present invention, wherein an inert liquid 4 is disposed on at least part of the inner surfaces of the valve films 11, 12 in the air passage 2.

A ninth aspect of the present invention provides the check valve according to the first aspect of the present invention, wherein the first side seal section 21 includes an introduction section 211 on the upward flow side and an expulsion section 213 on the downward flow side, and the expulsion section 213 is extended in a lateral direction so as to approach the second side seal section 22.

A tenth aspect of the present invention provides a compression bag equipped with a check valve. As a compression bag 5, it is formed with at least two bag films 51, 52 of synthetic resin that are placed one on the other and bonded at parts thereof together. The compression bag comprises a storage section 62 provided with an opening 61, and a deaeration opening 63 for removing air in the storage section 62 other than the opening 61. The storage section 62 is able to contain an item for storage. The respective bag films 51, 52 have a rectangular shape in a plan view. The opening 61 is provided in the upper part of the compression bag 5 and is hermetically closable by a closing means 61*a*, while the deaeration opening 63 is provided in the lower part of the compression bag 5. A check valve 1 according to the third aspect of the present invention is installed between the storage section 62 and the deaeration opening 63 with the inlet side of the air passage 2 towards the top and the outlet side towards the bottom. The installation of the check valve 1 is achieved by forming a unifying seal section 64 where the valve films 11, 12 and the bag films 51, 52 are bonded together. Except through the air passage 2, air is prevented from flowing between the storage section 62 and the deaeration opening 63. A heat resistant coating 7 is disposed on at least part of the inner surfaces of the valve films 11, 12 in the air passage 2, and the part is taken in a portion that coincides with the unifying seal section 64.

An eleventh aspect of the present invention provides the compression bag equipped with a check valve according to the tenth aspect of the present invention, wherein elongate films are used for the valve films 11, 12 and a plurality of the check valves 1 are disposed parallel in the lengthwise direction of the valve films 11, 12 in such a manner that the air passages 2 and free sections 32 are respectively adjacent.

A twelfth aspect of the present invention provides an air cushion bag. As an air cushion bag 9, it is formed with at least two bag films 51, 52 of synthetic resin that are placed one on the other and bonded at parts thereof together. The air cushion bag comprises an air filling section 91 being able to be filled with air, and an air injection port 92*a* that can inject air into the air filling section 91. The respective bag films 51, 52 have a rectangular shape in a plan view, and the air injection port 92*a* is provided in the upper part of the air cushion bag 9. A check valve 1 according to the third aspect of the present invention is installed between the air filling section 91 and the air injection port 92*a* with the inlet side of the air passage 2 towards the top and the outlet side towards the bottom. The installation of the check valve 1 is achieved by forming a unifying seal section 93 where the valve films 11, 12 and the bag films 51, 52 are bonded together. Except through the air passage 2, air is prevented from flowing between the air filling section 91 and the air injection port 92*a*. A heat resistant coating 7 is disposed on at least part of the inner surfaces of the valve films 11, 12 in the air passage 2, and the part is taken in a portion that coincides with the unifying seal section 93.

A thirteenth aspect of the present invention provides the air cushion bag according to the twelfth aspect of the present invention, wherein elongate films are used for the valve films 11, 12 and a plurality of the check valves 1 are disposed parallel in the lengthwise direction of the valve films 11, 12 in such a manner that the air passages 2 and free sections 32 are respectively adjacent.

A fourteenth aspect of the present invention provides the air cushion bag according to the thirteenth aspect of the present invention, wherein a plurality of air filling sections 91 are formed in parallel, and one check valve 1 is provided per each air filling section 91.

BRIEF DESCRIPTION OF THE DRAWINGS

FIG. 2 shows a check valve relating to one embodiment of the present invention during deaeration, in which FIG. 2(A) is a plan view of the feature of the valve; FIG. 2(B) is a schematic cross-sectional view along B-B in FIG. 2(A); FIG. 2(C) is a schematic cross-sectional view along C-C in FIG. 2(A)

FIG. 3 shows a check valve relating to one embodiment of the present invention, at the moment when deaeration has finished, in which FIG. 3(A) is a plan view of the feature of the valve; and FIG. 3(B) is a schematic cross-sectional view along E-E in FIG. 3(A), showing a state where the valve is installed on a compression bag.

FIG. 4 shows a check valve relating to one embodiment of the present invention, after finishing deaeration, in which FIG. 4(A) is a plan view of the feature of the valve; FIG. 4(B) is a schematic cross-sectional view along F-F in FIG. 4(A), showing a state where the valve is installed on a compression bag; FIG. 4(C) is a schematic cross-sectional view along G-G in FIG. 4(A); and FIG. 4(D) is a schematic cross-sectional view along H-H in FIG. 4(A).

BEST MODE TO PRACTICE THE INVENTION

Figure 1A:
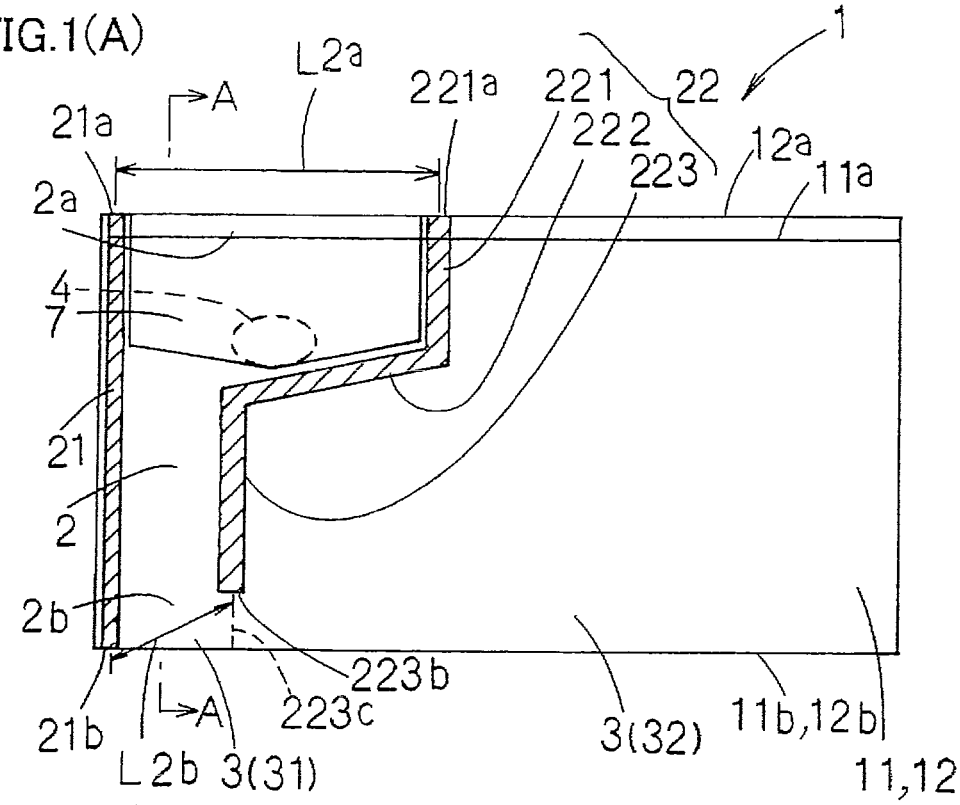
FIG. 1(A) is a plan view showing a check valve relating to one embodiment of the present invention.
Figure 1:
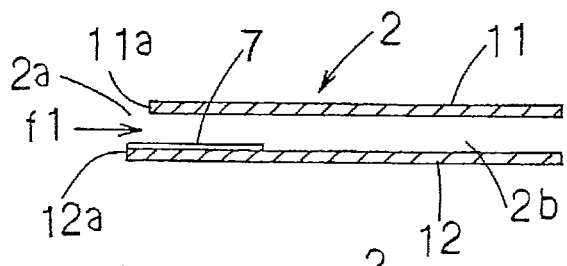
FIG. 1(B) is a schematic cross-sectional view along line A-A in FIG. 1(A), when the air passage is open.
FIG. 1(C) is a schematic cross-sectional view along line A-A in FIG. 1(A), when the air passage is closed.
Figure 1:
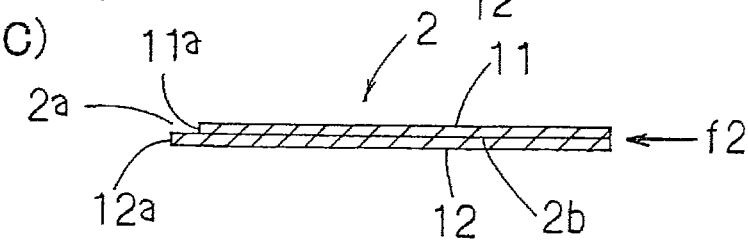
Figure 6:
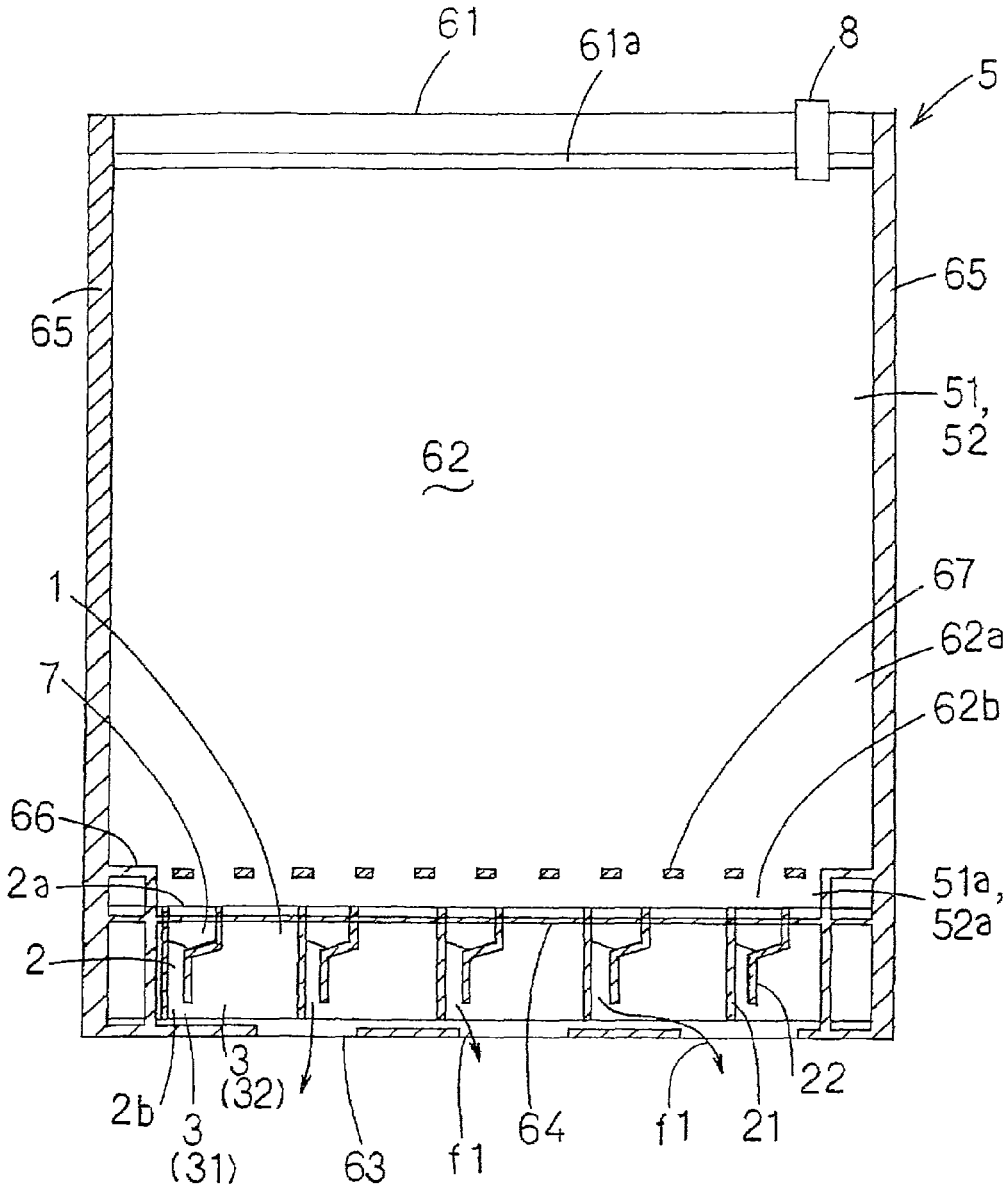
FIG. 6 is a plan view showing a compression bag equipped with a check valve relating to one embodiment of the present invention.

Embodiments of the present invention will be described below with reference to the drawings. First, description is given of a check valve for a compression bag as a first embodiment. FIG. 1 is a plan view showing the check valve according to the present embodiment, and FIG. 6 is a plan view showing a compression bag equipped with the check valve of the present embodiment. The expressions "upward flow" and "downward flow" in the following description are based on the direction of the air flow when the air passage is open as shown in FIG. 1(B), and expressions indicating up, down, left and right relate to the positional situation shown in FIG. 1(A) and FIG. 6. Further, in expressions relating to "front" and "rear", "front" indicates the upper side in the state shown in FIGS. 1(B) and 1(C), and "rear" indicates the lower side in these drawings.

As shown in FIG. 1(A), the check valve 1 according to the present embodiment is open with respect to air flow f1 in one direction from the upper side to the lower side (see FIG. 1(B)), and it is closed with respect to air flow f2 in the other direction from the lower side to the upper side (see FIG. 1(C)). This check valve 1 is principally attached to a compression bag 5 such as that shown in FIG. 6, and is used in order to remove air in the storage section 62 of the compression bag 5. Equipping of this check valve 1 is not limited to a compression bag as in the present embodiment, and it may also be applied, as in a second embodiment described below, to a bag that is used to be filled with gases such as air. Further, the check valve 1 may also be used as a check valve for general fluids such as gases other than air and liquids such as water.

The check valve 1 according to the present embodiment comprises two valve films 11 and 12 of synthetic resin that are placed one on the other. In these valve films 11 and 12, desirably, at least the surfaces forming the inner faces of the air passage 2 have weak contact property, thereby making the valve films 11 and 12 readily closely contact together. The valve films 11 and 12 used in the present embodiment have a rectangular shape as shown in FIG. 1, but they may also have another shape.

By bonding together a portion of the valve films 11 and 12, for example, by heat seal, an air passage 2 is provided where air is allowed to pass through the valve films 11 and 12 from an inlet 2*a* to an outlet 2*b*, and it is closable by the valve films 11 and 12 that closely contact together. This air passage 2 is defined by the two seal sections 21, 22 formed by bonding the valve films 11 and 12 together.

When the air flow f1 passes in the aforementioned direction, as shown in FIG. 1(B), the valve films 11 and 12 are pushed apart forcibly and opened by the air flow f1. However, in all other cases, the valve films 11 and 12 closely contact together, as shown in FIG. 1(C). Therefore, the air passage 2 maintains a closed state in which the air flow f2 in the other direction is not allowed to pass. The detailed movement of the valve films 11 and 12 with the air passage 2 closed will be described hereinafter.

Figure 5:
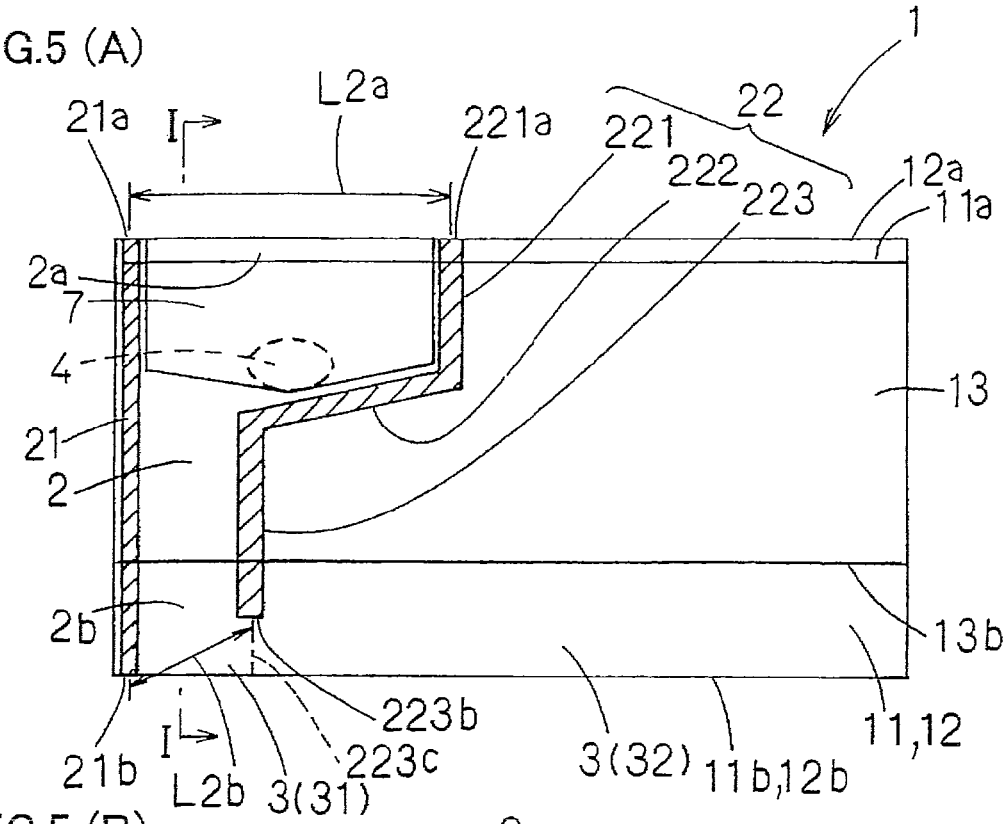
FIG. 5(A) is a plan view showing a check valve relating to a further embodiment of the present invention.
FIG. 5(B) is a schematic cross-sectional view along line I-I in FIG. 5(A), when the air passage is open.
FIG. 5(C) is a schematic cross-sectional along line I-I in FIG. 5(A), when the air passage is closed.
Figure 5:
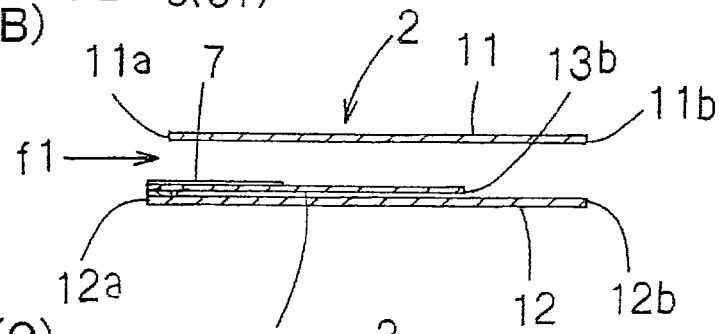
Figure 5:
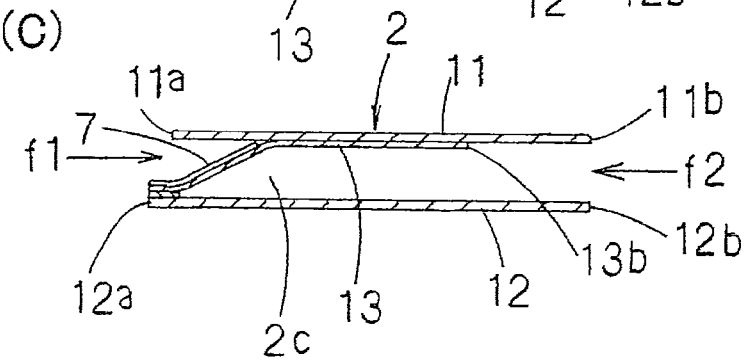

In the present embodiment, the air passage 2 is constituted by the two valve films 11 and 12, but as shown in FIG. 5, a structure may also be adopted in which an intermediate film 13 is disposed between the two valve films 11 and 12, wherein the base end side of the intermediate film 13 is bonded to the rear side valve film 12, as shown in FIG. 5(B), and the front end side thereof is movable inside the air passage 2 and able to make a close contact to the front side valve film 11, as shown in FIG. 5(C). The air passage 2 may have a structure to be closable by the intermediate film 13 and the front side valve film 11 that closely contact together, in addition to the close contact between the valve films 11 and 12 described above. In the example illustrated here, the downward flow side edge of the intermediate film 13 is positioned further toward the upward flow side than the downward flow side edges 11*b* and 12*b* of the valve films 11 and 12, but it is also possible for the positions of the respective edges 11*b*, 12*b* and 13*b* to be aligned with each other.

In the illustrated structure, desirably, the opposing faces of the rear side valve film 12 and the intermediate film 13, which are separated except the base end section when the air passage 2 is closed, do not have a weak contact property in order to make the films 12 and 13 less liable to closely contact together.

In the check valve 1 according to the present embodiment, as shown in FIG. 1, the aforementioned seal sections 21 and 22 comprise a first side seal section 21 which has a linear shape extending in the up/down direction in the figure, following the left-hand edge of the valve films 11, 12 in the figure, and a second side seal section 22 which is formed further on the right-hand side with respect to the first side seal section 21 in the figure, and which extends in the up/down direction in the figure, but is formed in a bent fashion.

The second side seal 22 in the present embodiment comprises three sections; an introduction section 221, an intermediate section 222 and an expulsion section 223, from the top downwards in the drawings. The introduction section 221 is disposed toward the inlet side of the air passage 2, and the expulsion section 223 is disposed toward the outlet side of the air passage 2.

Here, the upward flow side end 221*a* of the introduction section 221 and the upward flow side end 21*a* of the first side seal section 21 form the inlet 2*a* of the air passage. Specifically, the inlet 2*a* is defined by the straight line which links the respective end sections 221*a* and 21*a*. Further, the downward flow side end 223*b* of the expulsion section 223 and the downward flow side end 21*b* of the first side seal section 21 form the outlet 2*b* of the air passage. More specifically, the outlet 2*b* is defined by the straight line which links the respective end sections 223*b* and 21*b*. The intermediate section 222 is connected between the introduction section 221 and the expulsion section 223.

In the second side seal 22, the intermediate section 222 is formed more closely to the first side seal section 21 than the introduction section 221, and the expulsion section 223 is formed more closely to the first side seal section 21 than the intermediate section 222. Accordingly, the dimension L2*b* between the respective end sections of the first side seal section 21 and the second side seal section 22 on the outlet side of the air passage 2 is smaller than the dimension L2*a* between the respective end sections on the inlet side. In other words, the width of the air passage 2 in the present embodiment narrows toward the downward flow side.

In the present embodiment, each of the introduction section 221, the intermediate section 222 and the expulsion section 223 is formed by straight lines, and as shown in FIG. 1, the introduction section 221 and the expulsion section 223 are formed in parallel with the first side seal section 21.

Figure 7A:
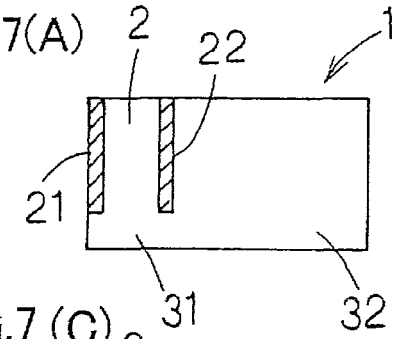
FIGS. 7(A)-7(H) are schematic plan views showing other embodiments of a check valve relating to the present invention.
Figure 7B:
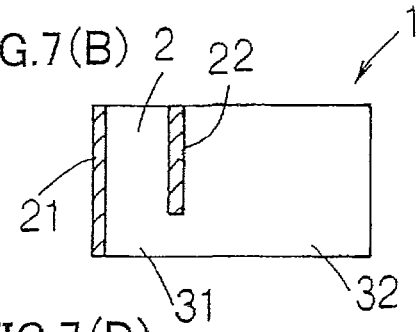
Figure 7:
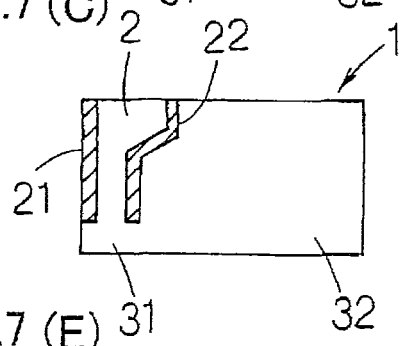
Figure 7:
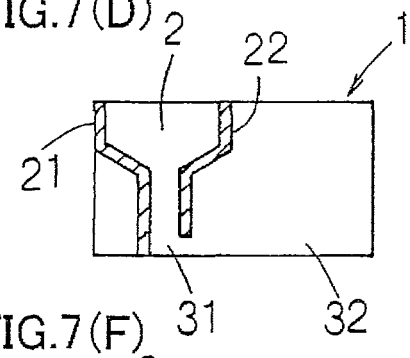
Figure 7:
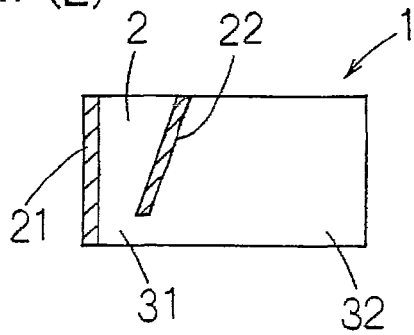
Figure 7F:
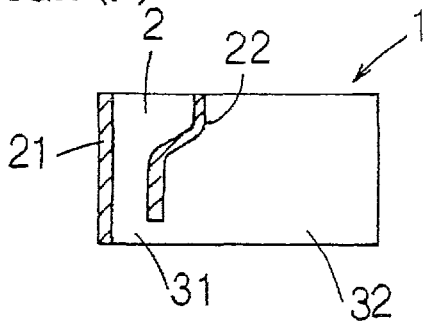
Figure 7:
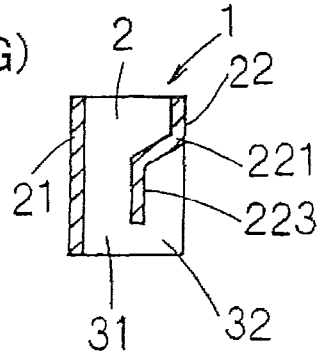
Figure 7:
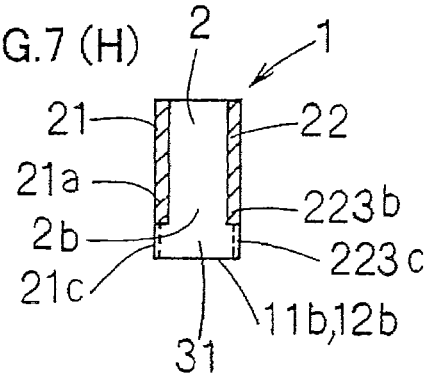

The mode of the seal sections 21 and 22 is not limited to that shown in the present embodiment, and it may be modified in various ways. For example, it is also possible to dispose the respective seal sections 21 and 22 in a parallel fashion, as shown in FIGS. 7(A), 7(B) and 7(H), by forming both of the seal sections 21 and 22 as straight lines, in such a manner that the air passage 2 does not narrow, and it is also possible to cause the air passage 2 to narrow by forming the second side seal section 22 as a straight line extending in an oblique direction, as shown in FIG. 7(E). Further, it is also possible to form the second side seal section 22 as a continuous curved line, as shown in FIG. 7(F). Moreover, in the case of the present embodiment, the first side seal section 21 is formed in a straight line and the second side seal section 22 is curved, but as shown in FIG. 7(D), it is also possible to form both of the seal sections 21 and 22 in curved lines, in a laterally symmetrical configuration.

Figure 2:
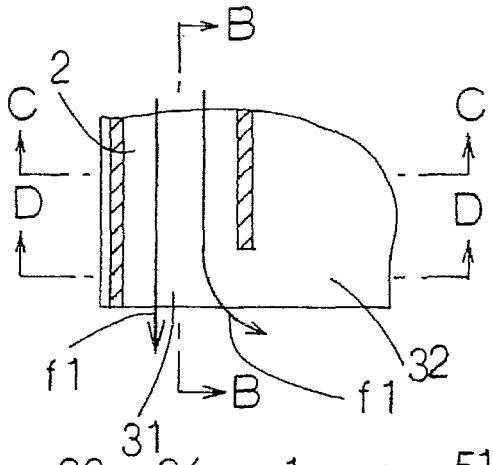
Figure 2:
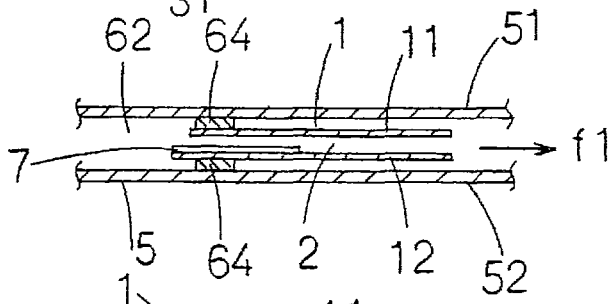
Figure 2:
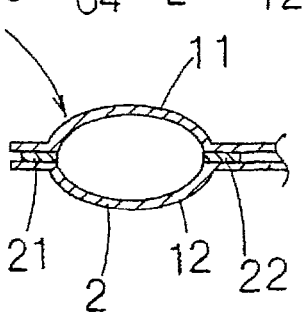
Figure 2D:
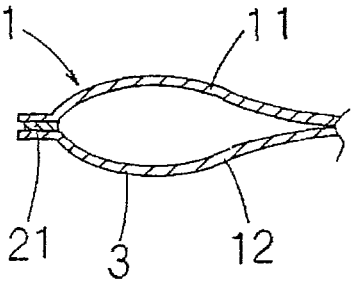
FIG. 2(D) is a schematic cross-sectional view along D-D in FIG. 2(A).

In the check valve 1, as shown in FIG. 1(A), a non-sealed section 3 is formed outside the air passage 2. This non-sealed section 3 consists of a passage extension section 31 and a free section 32. Here, the passage extension section 31 is a portion located on the downward flow side from the outlet 2*b* of the air passage 2, and air that has passed through the air passage 2 continues to pass through this section. On the other hand, the free section 32 is a section in which the valve films 11 and 12 are closed by a unifying seal 64 formed when installing the valve on the compression bag 5, as shown in FIG. 6, for example, and air does not pass through this section as it does through the air passage 2. As shown in FIGS. 2(A) and 2(D), a part of the air flow into the air passage extension section 31 from the air passage 2 may pass through the free section 32.

Here, in the present embodiment, the downward flow side end 223*b* of the expulsion section 223 of the second side seal section 22 is formed further toward the upward flow side (the upper side in the figure) than the downward flow side end 21*b* of the first side seal section 21. Therefore, the passage extension section 31 in the check valve 1 according to the present embodiment is a triangular-shaped portion defined by three lines; the outlet 2*b*, namely, the line linking the downward flow side end 21*b* of the first side seal section 21 and the downward flow side end 223*b* of the expulsion section 223 of the second side seal section 22, the downward flow side edges 11*b* and 12*b* of the valve films 11 and 12, and the line of extension 223*c* of the second side seal 22 on the downward flow side of the expulsion section 223 of the second side seal 22 (indicated by a broken line).

This line of extension 223*c* is a virtual line which does not actually exist, and this virtual line 223*c* (line of extension 223*c*) is a straight line which links the downward flow side end 223*b* of the second side seal section 22, which is a shorter seal section, described above and the downward flow side edges 11*b* and 12*b* of the valve films 11 and 12. Particularly, in this embodiment, this virtual line 223*c* can be described as a line of extension 223*c* for which the second side seal section 22 is extended straight downward. Thus, the passage extension section 31 is a passage that links the outlet 2*b* of the air passage 2 and the downward flow side edges 11*b* and 12*b* of the valve films 11 and 12 and allows air to communicate. Air inside the air passage 2 flows out to the exterior through the air extension section 31.

When the air passage 2 is closed as shown in FIG. 1(C), the valve films 11 and 12 can closely contact together in this passage extension section 31, as the valve films 11 and 12 in the air passage 2.

In the present embodiment, as described above, by forming a first side seal section 21 further in the downward direction with respect to the second side seal section 22 in the figure, the first side seal 21 serves as a bone for the valve films 11 and 12 and prevents the valve films 11 and 12 from curling in the passage extension section 31, and hence there is no obstacle to close contact of the valve films 11 and 12 in the passage extension section 31.

As shown in FIGS. 7(A), 7(C) and 7(H), it is also possible to separate the downward flow side edges 11*b* and 12*b* of the valve films 11 and 12 from the downward flow side end 21*b* of the first side seal section 21, in such a manner that the respective seal sections 21 and 22, and the downward flow side edges 11*b* and 12*b* of the valve films 11 and 12 are not connected.

The free section 32 is adjacent to both the air passage 2 and the passage extension section 31. In other words, as shown in FIG. 1, in the non-sealed section 3, the portion to the left-hand side of the downward flow side line of extension 223*c* of the expulsion section 223 of the second side seal 22 forms the passage extension section 31, while the portion to the right-hand side forms the free section 32.

The passage extension section 31 and the free section 32 are connected, and distortion of the valve films 11 and 12 in the passage extension section 31 can be absorbed in the free section 32. Therefore, at least in the passage extension section 31, the tension of the valve films can be stabilized, consequently eliminating slackening or wrinkles, and the valve films 11 and 12 can be made reliably to closely contact together. Inverse flow of the air in the air passage 2 can be effectively prevented by locating the portion where the valve films 11 and 12 closely contact together in this way adjacent to the downward flow side of the air passage 2.

As described above, in order that a portion able to absorb distortion of the valve films 11 and 12 is ensured in the free section 32, it is necessary for the unifying seal 64 formed in installation to the compression bag 5, or for the seals formed separately from this in the free section 32 in order to prevent passage of air between the valve films 11 and 12, to be formed from the upward flow side edges 11*a* and 12*a* of the valve films 11 and 12 in the free section 32, up to the downward flow side end 223*b* of the expulsion section 223 of the second side seal 22, and a gap must be provided between these seals and the downward side edges 11*b* and 12*b* of the valve films 11 and 12.

Further, it is not essential to form the free section 32, and depending on the circumstances, it is possible for the non-sealed section 3 to comprise the passage extension section 31 only, as shown in FIG. 7(H). In this case, the passage extension section 31 is a square portion defined by the four lines; the outlet 2*b*, namely, the line linking the downward flow side end 21*b* of the first side seal section 21 and the downward flow side end 223*b* of the second side seal section 22, the downward flow side edges lib and 12*b* of the valve films 11 and 12, the downward flow side line of extension 21*c* of the first side seal 21 and the downward flow side line of extension 223*c* of the second side seal 22.

Even in this case, it is possible to eliminate distortion of the valve films 11 and 12 in the passage extension section 31, by staggering the valve films 11 and 12 in the left/right direction in the figure, in the passage extension section 31, and like the foregoing, the tension of the valve films can be stabilized, and the valve films 11 and 12 can be made reliably to closely contact together without slackening or wrinkles.

In addition to the foregoing, in the present embodiment, the width of the air passage 2 is narrowed toward the downward flow side, and the lateral dimension of the free section 32 is greater in the figure than the lateral dimension of the passage extension section 31 in FIG. 1(A). More specifically, in the present embodiment, the lateral dimension of the passage extension section 31 is 10 mm in the figure, whereas the lateral dimension of the free section 32 is 70 mm in the figure. Thus, by forming the free section 32 larger than the passage extension section 31 in this way, the above-described absorption of distortion in the free section 32 is performed more effectively.

Figure 3:
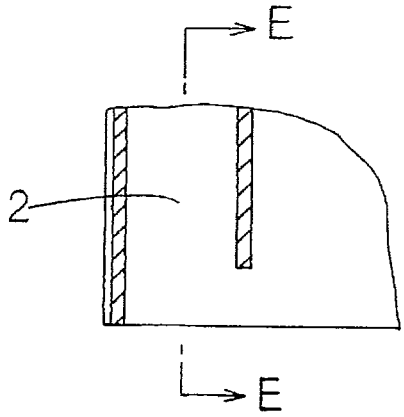
Figure 3:
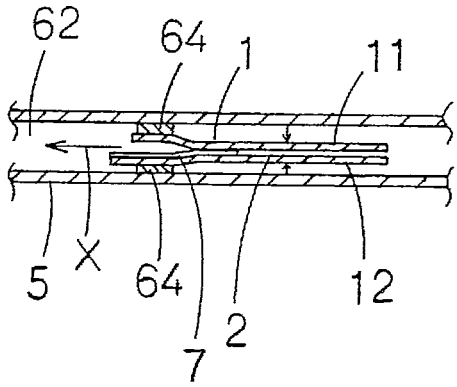
Figure 4:
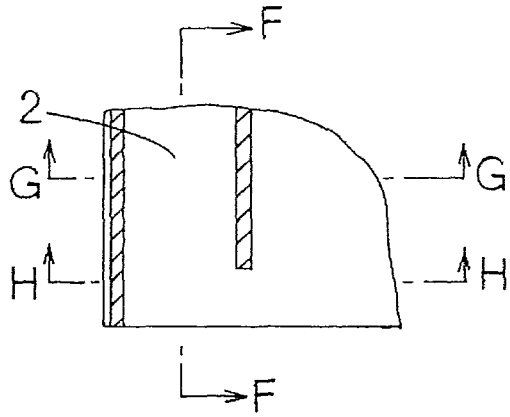
Figure 4:
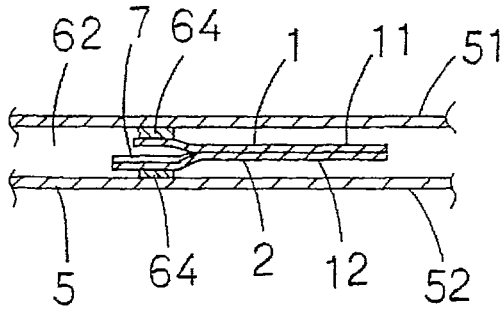
Figure 4:
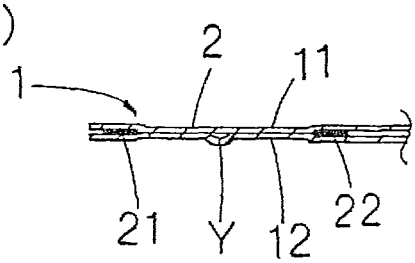
Figure 4:
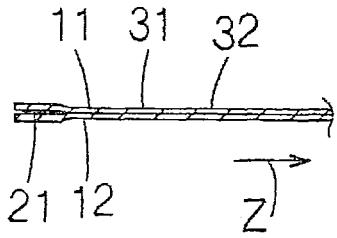

Here, the movement of the valve films 11 and 12 with the air passage 2 closed will be described in detail. As shown in FIG. 6, explained will be a state where a check valve 1 is installed to the compression bag 5 described below. For description, the cross-sectional views in FIG. 2 to FIG. 4 exaggerate the size in the vertical direction of the figure, compared to an actual size.

First, when the air present inside the storage section 62 of the compression bag 5, shown in FIG. 6, is removed, the opening 61 is closed by the closing means 61*a*, and pressure is applied from outside the bag by rolling up the storage section 62 or doing like this. The air inside the storage section 62 forms an air flow f1 and passes through the air passage 2 of the check valve 1, being expelled to the exterior of the bag. During this action the valve films 11 and 12 are pushed forcibly apart as shown in FIG. 2(B) of a sectional view along B-B. Here, as described above, since the second side seal section 22 ends at an intermediate point of the passage extension section 31, the air flow f1, as shown by the arrow in FIG. 2(A), also flows to the free section 32. FIG. 2(C) shows a sectional view along C-C in the lateral direction of the air passage 2 of the check valve 1 in this case, while FIG. 2(D) shows a sectional view along D-D in the lateral direction of the passage extension section 31 and the free section 32 of the check valve 1 in this case.

Next, FIGS. 3(A) and 3(B) show a momentary state when the aforementioned deaeration action has ended and the air flow f1 has ceased to pass through the air passage 2. In this case, the interior of the storage section 62 of the compression bag 5 assumes a state of negative pressure due to the expulsion of the air therein. Consequently, as shown in FIG. 3(B) of a sectional view along E-E, a force X acts on the valve films 11 and 12 in the air passage 2 so as to pull them towards the storage section 62, and hence the valve films 11 and 12 closely contact together. This close contact of the valve films 11 and 12 occurs within a very short period of time, and hence there is virtually no inverse flow of air through the air passage 2 during the movement of the valve films 11 and 12.

Next, FIGS. 4(A) to 4(D) show the cases where the valve films 11 and 12 described above closely contact together, and the air passage 2 is closed. In this case, as shown in FIG. 4(B) of a sectional view along F-F, the valve films 11 and 12 normally closely contact to each other, thus closing the air passage 2 completely, but as shown in FIG. 4(C) of a sectional view along G-G in the lateral direction of the air passage 2 of the check valve 1, a gap Y may occasionally arise between the valve films 11 and 12 due to slackening of the valve films 11 and 12. This is because the valve films 11 and 12 are fixed by the first side seal section 21 and the second side seal section 22, and hence relative displacement between the valve films 11 and 12 is restricted. On the other hand, in the passage extension section 31, the second side seal section 22 is not present, and therefore the valve films 11 and 12 are able to move in the direction of arrow Z, as shown in FIG. 4(D) of a sectional view along H-H in the lateral direction of the air passage 2 of the check valve 1. Consequently, it is possible to absorb any displacement between the valve films 11 and 12 in the free section 32, and therefore, no gaps Y such as that in FIG. 4(C) occur, and the valve films 11 and 12 can be made reliably to closely contact together in the passage extension section 31.

Even in the check valve 1 comprising of three films 11 to 13 illustrated in FIG. 5, like the foregoing, the valve films 11 and 12 closely contact together due to a force X that pulls them towards the storage section 62, but in addition to this, the intermediate film 13 and the front side valve film 11 closely contact together, as shown in FIG. 5(C), due to the aforementioned force X (in order to aid understanding, the valve films 11 and 12 are depicted in a separated fashion in FIG. 5(C)). Thereupon, a pocket-shaped space 2*c* may be provided between each of the valve films 11 and 12 and the intermediate film 13, but even in this case, the air flow f2 heading to flow inversely from the outlet 2*b* to the inlet 2*a* of the air passage 2 remains in this pocket-shaped space 2*c* and does not pass through the air passage 2.

Here, it is desirable that the dimension of the inlet 2*a* of the air passage 2 is large, since the air is guided smoothly into the air passage 2. Contrary to this, it is desirable that the dimension of the outlet 2*b* of the air passage 2 is small, since distortion is not liable to occur in the valve films 11 and 12. And, it is desirable that the dimension of the air passage 2 from the inlet 2*a* to the outlet 2*b* is large in order to ensure that the valve films 11 and 12 closely contact together in a reliable fashion. However, the dimensions of the respective sections of the check valve 1 will be determined by taking things into consideration, because balancing the dimensions with the size of the compression bag 5 to which the valve is applied, or ensuring a large storage section 62 in the compression bag 5 are functionally required.

With respect to the aforementioned dimensions, desirably, the lateral dimension between the introduction section 221 and the first side seal section 21 in the vicinity of the inlet 2*a* of the air passage 2 is taken to be 20 mm-60 mm. In the present embodiment, it is set as 30 mm. Further, desirably, the lateral dimension between the expulsion section 223 and the first side seal section 21 in the vicinity of the outlet 2*b* of the air passage 2 is taken to be 5 mm-30 mm. In the present embodiment, it is set as 10 mm. Desirably, the dimension of the check valve 1 in the vertical direction in the figure is 30 mm-100 mm. In the present embodiment, the dimension falls on the upward flow side edge 12*a* and the downward flow side edge 12*b* of the rear side valve film, and is taken as 45 mm.

As described above, since the distance between the first side seal section 21 and the second side seal section 22 can be set freely, it is possible to design a check valve 1 capable of passing the optimum amount of air through the air passage 2 in accordance with the size of the compression bag 5 to which the check valve 1 is installed.

In the present embodiment, the dimension of the check valve 1 in the lateral direction in the figure is taken as 80 mm, and the free section 32 has a dimension sufficiently larger than the passage extension section 31, but depending on the circumstances, it is also possible to make the right-hand ends of the valve films 11 and 12 in the figure coincide with the introduction section 221 of the second side seal section 22, as shown in FIG. 7(G), in such a manner that the free section 32 is formed solely between the expulsion section 223 of the second side seal section 22 and the right-hand ends of the valve films 11 and 12 in the figure.

Here, as shown in FIGS. 1(A)-1(C), the upward flow side edge 11*a* of the front side valve film 11 and the upward flow side edge 12*a* of the rear side valve film 12, both of the valve films being placed one on the other, are disposed in staggered positions, displaced towards the upward flow side and the downward flow side. In the present embodiment, the upward flow side edge 11*a* of the front side valve film 11 is disposed towards the downward flow side. The aforementioned displacement is desirably set within the range of 1 mm to 10 mm, and more desirably, 3 mm to 5 mm. This displacement is not essential in the present invention, but is desirably to be provided. Also, this displacement may be called "step difference".

The displacement between the edges 11*a* and 12*a* is provided in order to avoid the inlet 2*a* of the air passage 2 from being sealed due to dislocation of the unifying seal section 64 that is a heat seal formed between the check valve 1 and each of the bag films 51 and 52 when bonding the check valve 1 onto the bag films 51 and 52 as described hereinafter. Further, it also serves to make the valve films 11 and 12 readily open up during deaeration, in such a manner that the air flow f1 can be smoothly introduced to the air passage 2 during deaeration.

In the present embodiment, as shown in FIG. 1(A), the dimension of the valve films 11 and 12 in the vertical direction in the figure is the same in the sections where the air passage 2 is formed and the other sections of the films, but it is effective as long as a displacement as described above exists in the sections where the air passage 2 is formed.

An inert liquid 4, such as silicon oil, is at least partly disposed between the inner surfaces of the valve films 11 and 12. This liquid 4, due to its viscosity, has effects of reinforcing close contact between the valve films 11 and 12 when the air passage 2 is sealed. Desirably,—the liquid 4 has a low viscosity, since it is difficult to open up the air passage 2 if the viscosity is too high. However, even it is low, needed is the viscosity of a level that does not allow the liquid to leak out from the air passage 2.

Next, the compression bag 5 equipped with the aforementioned check valve 1 will be described. This compression bag 5 is formed with at least two bag films 51 and 52, which are made of synthetic resin and placed one on the other, by partly bonding the films together. The compression bag 5, as shown in FIG. 6, has a storage section 62 that includes an opening 61 and is able to contain an item such as clothing, and a deaeration opening 63 for removing air in the storage section 62 other than the opening 61. In the compression bag 5 according to the present embodiment, the opening 61, provided on the upper side in the figure, can be hermetically closed by a closing device, such as a fastener 61*a*, which closes by way of interlocking a recessed strip with a projecting strip. The deaeration openings 63 are provided on the lower side of the compression bag 5 in the figure. However, the opening 61 and the deaeration openings 63 can be positioned freely as long as they do not affect in the status where the check valve 1 is attached, as described hereinafter. As regards the number of deaeration openings 63, in the compression bag 5 according to the present embodiment, three deaeration openings 63 are provided, but this number may be varied. Further, the bag films 51 and 52 according to the present embodiment have a rectangular shape in a plan view, but they may also be formed in a circular shape, a polygonal shape, or other forms variously.

The aforementioned check valve 1 is, between the storage section 62 and a deaeration opening 63, attached with the inlet side of the air passage 2 towards the top and the outlet side towards the bottom. In the present embodiment, it is positioned within a range of 60 mm from the bottom of the compression bag 5. The check valve 1 is attached through forming a unifying seal section 64 in which the valve films 11 and 12, and the bag films 51 and 52 are bonded together. Except the air passage 2, air does not flow between the storage section 62 and the deaeration opening 63 by forming this unifying seal section 64.

In the present embodiment, elongate films are used as valve films 11 and 12, and a plurality of check valves 1 are disposed parallel in the lengthwise direction of these valve films, in such a manner that air passages 2 and free sections 32 are respectively adjacent, as shown in FIG. 6. Consequently, combined with similarly elongate bag films 51 and 52, compression bags 5 can be continuously manufactured, resulting in enhancement of productive efficiency. Moreover, when a plurality of check valves 1 are aligned in this fashion, the number of air passages 2 per compression bag 5 can be readily increased as the compression bag 5 becomes larger, especially extending the lateral dimension, and hence it is not difficult in deaeration with a large-size compression bags 5.

Aforementioned unifying seal section 64 is formed by heat sealing. Therefore, a heat resistant coating 7 is provided at least on part of the inner surfaces of the valve films 11 and 12 in the air passage 2 of the check valve 1, further coinciding with the unifying seal section, more specifically, as shown in FIG. 1(B), in the vicinity of the inlet 2*a* of the air passage 2, in order that the air passage 2 is not closed off due to melting of the valve films 11 and 12 under the effects of the heat applied during heat sealing. Here, "heat resistant" means a property whereby the material degenerates, by fusion, or the like, due to heat of the heat sealing operation, without affecting surrounding members, such as valve films 11 and 12.

In a check valve 1 consisting of three films 11 to 13 as illustrated in FIG. 5, a heat resistant coating 7 is provided on the surface of the valve film 11 or the intermediate film 13 facing onto the space which is formed when the valve is opened and where the air flow f1 passes, specifically, on the surface adjacent to the inlet 2*a* of the air passage 2, as shown in FIG. 5(B).

In the compression bag 5 according to the present embodiment, the storage section 62 comprises an item storage portion 62*a* where an item is actually contained, and an air introduction portion 62*b* which lies between the item storage portion 62*a* and the check valve 1, wherein valve protection seals 67 are formed at the boundary between these portions 62*a* and 62*b*. The valve protection seals 67 are formed by intermittently bonding the bag films 51 and 52 together. The interval at which the valve protection seals 67 are formed may be such that air is allowed to pass between the portions 62*a* and 62*b* and the seals do not affect the introduction of air into the air passages 2. In the present embodiment, the dimension of each valve protection seal 67 is 10 mm in the left/right direction in the figure, and the interval between the valve protection seals 67 is 25 mm. Further, the form of the valve protection seals 67 can be modified variously, however, it is desirable they have a form, for example, such as a circular form, which makes less resistance when air passes between the portions 62*a* and 62*b*.

Forming of the valve protection seals 67 in this way enables the item such as clothing contained in the item storage portion 62*a* to be prevented from being sucked into the air passages 2 by the air flows f1. And, even when stuffing of the item into the item storage portion 62*a* makes the bag films 51 and 52 curve, portions of the bag films 51 and 52, namely, the downward flow side films 51*a* and 52*a* situated in the air introduction portion 62*b*, do not follow the curving, achieving a non-deformed state. Consequently, it is possible for the check valves 1 to maintain a flat state without being affected by the stuffed item, resulting in opening and closing the air passages 2 reliably. However, it is not essential to form these valve protection seals 67, and they may be omitted.

Next, a concrete description is given of a method of manufacturing the check valve 1 shown in FIG. 1 and the compression bag 5 shown in FIG. 6.

A long film rolled up in the form of a roll is used for the valve films 11 and 12 according to the present embodiment. Specifically, a film having a width of 45 mm and a length of 1000 m is used.

First, a heat resistant coating 7 is coated by means of gravure printing or the like onto part of the surface of the rear side valve film 12 facing the front side valve film 11, specifically, in the vicinity of the position where the inlet 2*a* of the air passage 2 is to be formed. The width dimension of the front side valve film 11 is then reduced by approximately 5 mm. This dimensional difference forms the above-described displacement of the edges 11*a* and 12*a*.

Either of the valve films 11 and 12 is coated with silicon oil 4 onto the surface of the portion where an air passage 2 is to be formed. This coating operation may be performed by painting with a brush or the like, or by spraying.

The two valve films 11 and 12 are then placed one on the other, and a first side seal section 21 and a second side seal section 22 are formed by heat sealing the films, as illustrated in FIG. 1(A). The first side seal section 21 is formed throughout the whole width of the valve films 11 and 12 in this operation. On the other hand, the downward flow side end section 223*b* of the second side seal section 22 does not coincide with the downward flow side edges 11*b* and 12*b* of the valve films 11 and 12, thus providing a gap. This gap is the line of extension 223*c* of the seal section 22, which forms the boundary between the passage extension section 31 and the free section 32 described above.

The check valve 1 formed, as shown in FIG. 1(A), in this way is sandwiched between the bag films 51 and 52, and the unifying seal section 64 is formed, thereby unifying the valve and the bag films. Side seal sections 65 are then formed on the perimeter edges of the bag films 51 and 52, except the portions where the opening 61 and the deaeration opening 63 are to be formed. At the opening 61, a fastener 61*a* of a closing means is attached. Further, as needed, a slider 8 is provided to aide opening and closing of the zip fastener 61*a*. Thus the compression bag 5 is completed.

Depending on conditions between the position where the heat resistant coating 7 is deposited in the check valve 1, and the bag films 51 and 52, heat sealing is ineffective at the portion where the heat resistant coating 7 overlaps, thus the side seal sections 65 are not formed, and hence air may leak. In the present embodiment, in order to prevent disadvantage like this, inner seal sections 66 are further formed to the inner side from the side seal sections 65 formed on the right and left-hand edges of the compression bag 5 in the figure. In other words, the check valve 1 is sure to be bonded to the bag films 51 and 52 at the side seal section 65 and/or inner seal section 66, except the portion such as the free section 32 where the heat resistant coating 7 is provided.

The check valve 1 is not fixed to the bag films 51 and 52 at any positions other than the unifying seal section 64, the side seal sections 65 and the inner seal sections 66. Therefore, as described above, the free section 32 is hardly disturbed in absorbing distortion of the valve films 11 and 12 in the passage extension section 31.

Next, an air cushion bag 9 equipped with the same check valve 1 as in the foregoing will be described as a second embodiment. This air cushion bag 9 is formed with at least two bag films 51 and 52, which are made of synthetic resin and placed one on the other, by partly bonding the films together. In order words, this air cushion bag 9 is the same in the basic structure as the aforementioned compression bag 5. The air cushion bag 9, as shown in FIG. 8, has an air filling section 91 that can be filled with air and an air injection port 92*a* that allows injecting air into this air filling section 91.

Figure 8:
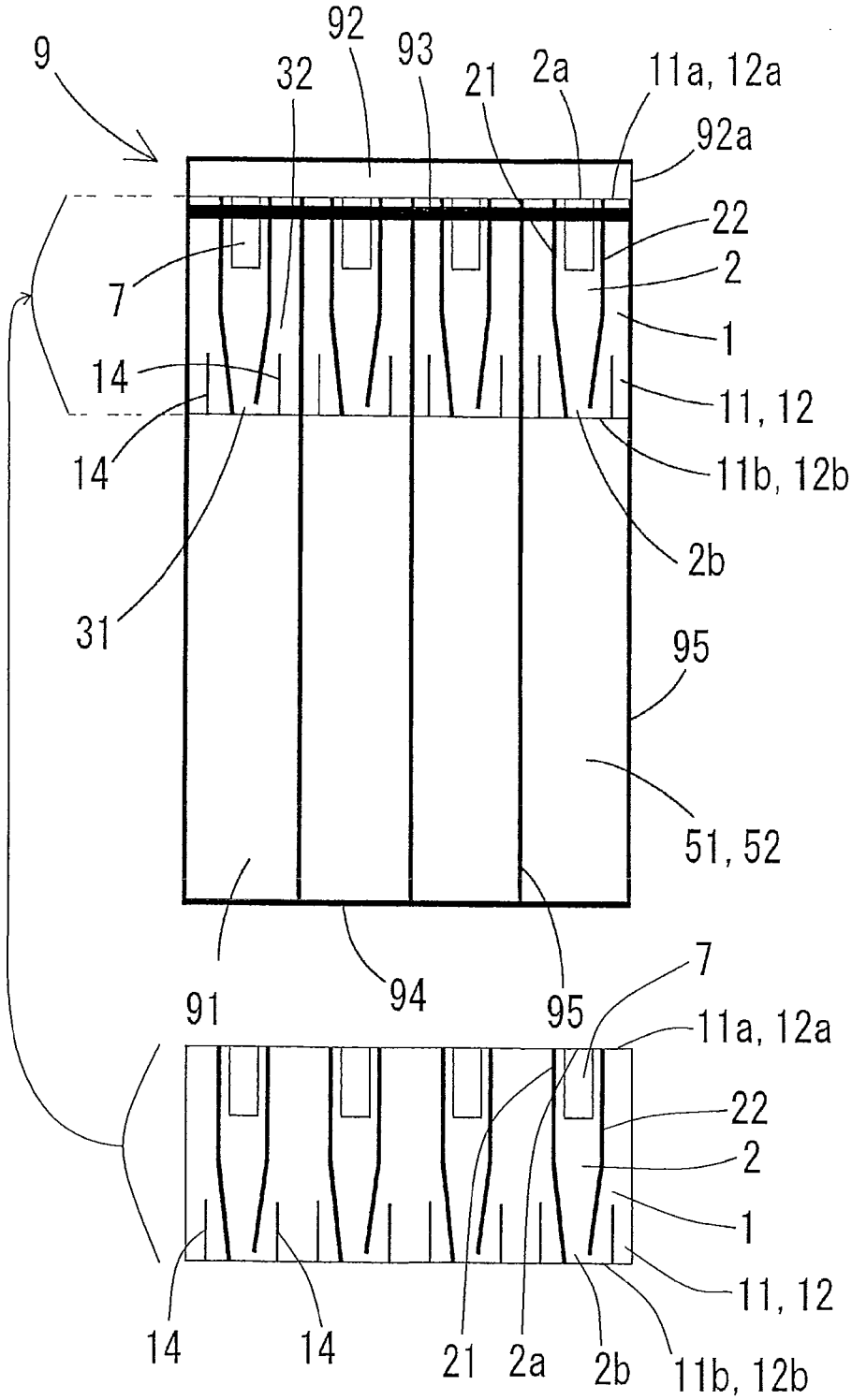
FIG. 8 is a plan view showing an air cushion bag relating to a second embodiment of the present invention.

As shown in FIG. 8, the air filling section 91 according to the present embodiment has a strip shape, and a plurality of air filling sections 91 are arranged parallel in the lateral direction. The number of air filling sections 91 to be provided in the air cushion bag 9 can be arbitrarily set. The air filling sections 91 are sectioned by a lower end seal 94 formed on the lower end shown in FIG. 8 of the bag films 51 and 52, a plurality of sectioning seals 95 formed parallel in the up/down direction in the figure, and a unifying seal section 93 described later. In the present embodiment, one check valve 1 is provided per each air filling section 91. Thus, in the first embodiment described above, no boundary is provided between the check valve 1 and the check valve 1, whereas in this embodiment, at a stage where the valve films 11 and 12 are installed between the bag films 51 and 52, the respective check valves 1 are sectioned by the sectioning seals 95 from each other.

Although illustration is omitted, cut lines such as perforations may be formed at the position of the sectioning seals 95, in such a manner that at least one air filling section 91 can be separated at the cut line from other air filling sections 91. In this case, it is desirable that not a single but two sectioning seals 95 are formed, and a cut line is formed between these two sectioning seals 95.

However, the present invention is not limited to the structure of the present embodiment, and for example, two or more check valves 1 may be provided per each air filling section 91.

Further, a filling air passage 92 is provided so as to be orthogonal to the direction in which the respective air filling sections 91 extend, and an end (right end in the figure) of this filling air passage 92 is opened to serve as the air injection port 92*a*. The filling air passage 92 is closed off by forming the seals, except the section where the air injecting port 92*a* is formed and the section communicating with the inlet 2*a* of the air passage 2 of the check valve 1.

The bag films 51 and 52 according to the present embodiment have a rectangular shape in a plan view, but like the aforementioned compression bag 5, they may also be formed in a circular shape, a polygonal shape, or other forms variously. The shape of the air filling sections 91 is also not limited to a strip shape, but it may have various shapes. Moreover, in the present embodiment, since a single filling air passage 92 is provided for a plurality of air filling sections 91, a single air injecting port 92*a* is provided, but a plurality of air injecting ports 92*a* may be provided per air filling section 91.

The check valve 1 in the present embodiment is, between the air filling section 91 and the air injection port 92*a*, attached with the side of the inlet 2*a* of the air passage 2 towards the top and the side of the outlet 2*b* towards the bottom. The check valve 1 is attached through forming a unifying seal section 93 in which the valve films 11 and 12, and the bag films 51 and 52 are bonded together. This unifying seal section 93 is, in the present embodiment, formed so as to be orthogonal to the direction in which the respective air filling sections 91 extend.

Also in the present embodiment, like the aforementioned compression bag 5, elongate films are used as valve films 11 and 12, and a plurality of check valves 1 are disposed parallel in the lengthwise direction of these valve films 11 and 12, as shown in FIG. 8, in such a manner that air passages 2 and free sections 32 are respectively adjacent. The aforementioned sectioning seals 95 are formed so as to be overlapped with the free sections 32. In this embodiment, as described above, since the sectioning seals 95 section the check valves 1 one by one, a space portion between the second side seal section 22 and the right-hand sectioning seal 95 in the figure forms the free section 32. A space portion between the first side seal section 21 and the left-hand sectioning seal 95 in the figure forms a closed space 33 sectioned by the sectioning seal 95, the unifying seal section 93, and the first side seal section 21, and there is substantially no air communication.

Next, the structure of the check valve 1 according to the present embodiment will be described. The basic structure is the same as that of the check valve 1 shown in FIG. 1, and provided is an air passage 2 defined by two seal sections 21, 22 formed by bonding the valve films 11 and 12 together.

Here, there can be mentioned, as a structure particularly suitable for the air cushion bag 9 according to the present embodiment, that a slit 14 is formed in each of the valve films 11 and 12. However, in the present invention, it is not essential to form these slits 14, and a check valve 1 without slits 14 is also included in the technical scope of the present invention.

These slits 14 are formed on the downward flow end side of the check valve 1. More specifically, the slits 14 follow the air passage 2 and the passage extension section 31 of the check valve 1, and are formed so that the downward flow side edges 11*b* and 12*b* of the valve films 11 and 12 are divided. Therefore, the slits 14 are formed in the aforementioned free section 32. In the present embodiment, two slits 14 are formed, in such a manner that the slits 14 sandwich the air passage 2 and the passage extension section 31 from both sides in the lateral direction, however, only one of either slit may be formed, without limitation to the two slits 14.

The dimension of the slit 14 is taken as 17 mm, whereas in the present embodiment, the dimension of the check valve 1 in the air flow direction is 50 mm. Desirably, the ratio with respect to the dimension of the check valve 1 in the air flow direction is taken as ⅓ or more and ⅔ or less. The slit 14 may also be formed with other dimensions, but the following effects of the slit 14 can be weakened when the ratio is less than ⅓, and it becomes highly likely that a defect occurs, such as a displacement of the films, in the bag-making process, when the ratio exceeds ⅔.

Figure 9:
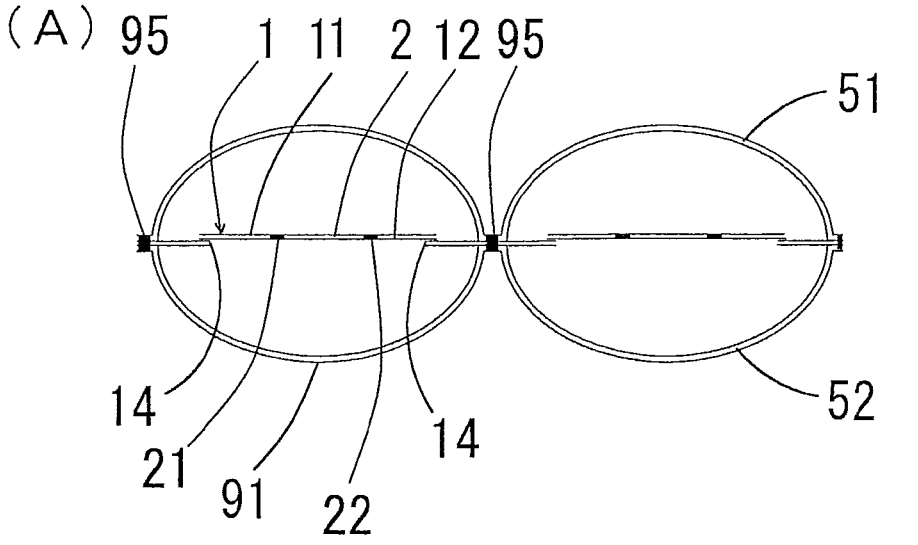
FIG. 9(A) is a schematic cross-sectional view showing a shape of a check valve, in the air cushion bag relating to the second embodiment of the present invention, in a state where air filling sections are inflated.
FIG. 9(B) is a schematic cross-sectional view showing a shape of a check valve in the same state, when no slits are provided in the check valve.
Figure 9:
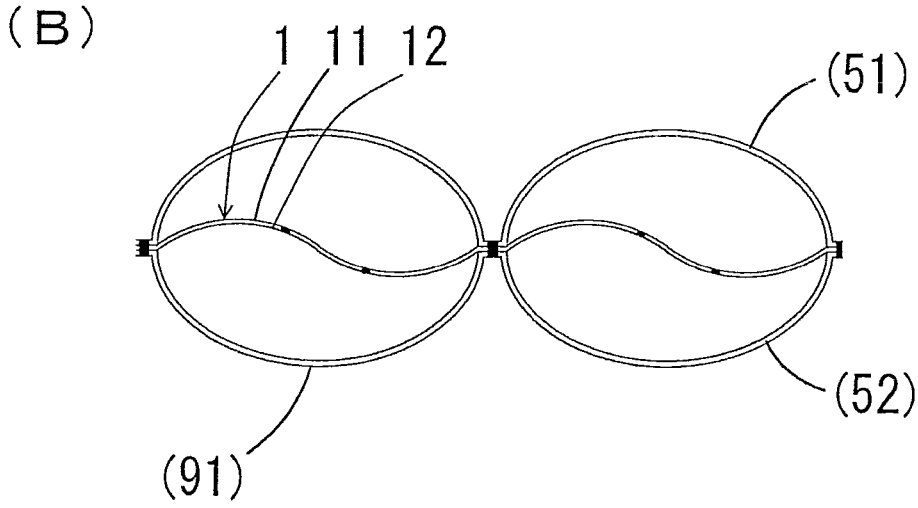

Effects of the slits 14 will be described. The air filling section 91 inflates as air is filled in the air filling section 91. Due to the inflation, the dimension in the lateral direction of the air filling section 91 is reduced. Therefore, when the slits 14 are not formed, the check valve 1 is compressed in the lateral direction to cause slackening, as shown in FIG. 9(B). On the other hand, by forming the slits 14 on the downward flow end side of the check valve 1, a portion toward the downward flow side edges 11*b* and 12*b* of the valve films 11 and 12 can be brought into a free state in the air filling section 91. Therefore, as shown in FIG. 9(A), the check valve 1 can maintain a flat state, without slackening.

Conventionally, in an air cushion bag as in the present embodiment, it has been necessary, in anticipation of air leakage from the check valve due to the aforementioned slackening, to set the length (length in the air flow direction) of the check valve a little longer. On the other hand, in the check valve 1 of the present embodiment, the check valve 1 is made less liable to cause slackening by forming the slits 14, and thus there is no functional problem even when the length of the check valve 1 is shorter than it conventionally is. Therefore, the check valve 1 can be provided in a compact fashion, and thus the valve films 11 and 12 can be saved. The slits 14 are, even in the compression bag 5, like the present embodiment, effective for preventing slackening.

Figure 10:
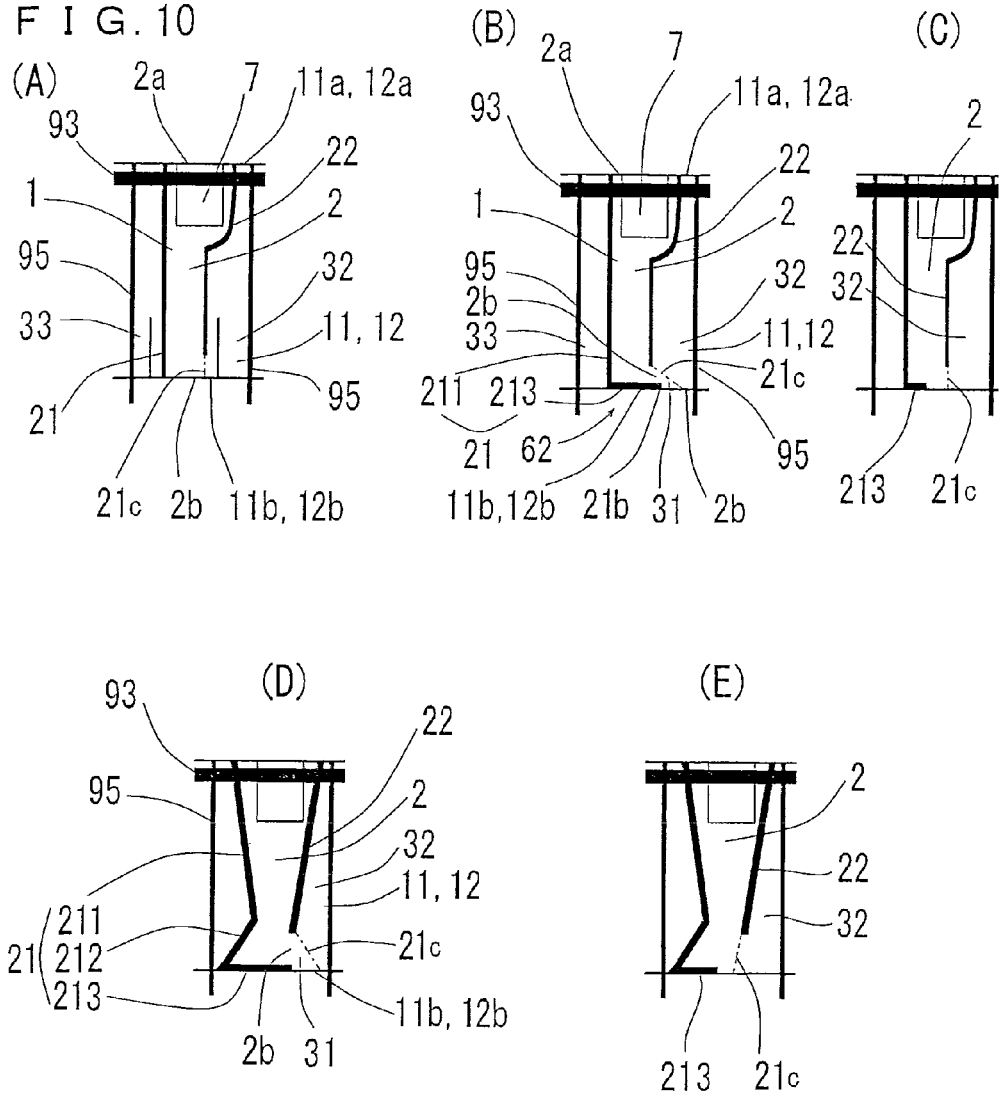
FIGS. 10(A)-10(E) are schematic plan views showing other embodiments of a check valve relating to the present invention.

The present embodiment can be appropriately modified within the scope of the claims, and for example, as shown in FIG. 10(A), the first side seal section 21 is formed as a straight line. On the other hand, the second side seal section 22 is formed at the downward flow side as a straight line in parallel with the first side seal section 21, and formed at the upward flow side as a curved line where the distance with respect to the first side seal section 21 gradually increases, in such a manner that the distance becomes a maximum interval at the upward flow side edges 11*a* and 12*a* of the valve films 11 and 12. The slits 14 are formed, on the downward flow side of both seal sections 21 and 22, in parallel with these, and the right-hand slit 14 in the figure is formed in the valve films 11 and 12 in the free section 32, while the left-hand slit 14 in the figure is formed in the valve films 11 and 12 in the closed space 33. The effects of the slits 14 are substantially the same as those in FIG. 9.

Next, description will be given of still another embodiment based on FIG. 10(B). This embodiment is modified in the form of the air passage 2, and other aspects of the structure are substantially the same as those in FIG. 10(A). Although not illustrated, slits 14 may also be provided. The first side seal section 21 of the air passage 2 of this embodiment includes an introduction section 211 extending in the up/down direction (from the upward flow side end to the lower side) and an expulsion section 213 extending in the lateral direction (direction to approach the second side seal section 22) from the downward flow side end of this introduction section 211. This expulsion section 213 prevents inverse flow of air from the storage section 62 from directly entering the air passage 2 to improve the effect to prevent inverse flow of the check valve 1. In this example, the passage extension section 31 is defined by the outlet 2*b* of the air passage 2, the downward flow side edges 11*b* and 12*b* of the valve films 11 and 12, and a virtual line 21*c*. This virtual line 21*c* links the downward flow side end section 21*b* of the first side seal section 21 and the downward flow side edges 11*b* and 12*b* of the valve films 11 and 12, and the valve films 11 and 12 are not bonded together at this virtual line 21*c*, and air in the air passage 2 flows out of the valve films 11 and 12 through the passage extension section 31 from the outlet 2*b*. In FIG. 10(B), the virtual line 21*c* does not coincide with a line of extension of the second side seal section 22, but as shown in FIG. 10(C), by shortening the expulsion section 213, the virtual line 21*c* and the line of extension may also be made to coincide with each other. Further, the front end of the expulsion section 213 may be located on the line of extension. Either in the embodiment of FIG. 10(B) or in the embodiment of FIG. 10(C), the free section 32 is formed lateral to the second side seal section 22.

Next, description will be given of still another embodiment with reference to FIG. 10(D). In this embodiment, the introduction section 211 of the first side seal section 21 and the second side seal section 22 are formed inclined, in such a manner that these mutually approach from the upward flow side toward the downward flow side. However, the first side seal section 21 is bent in an intermediate section 212 located towards the downward flow side of the introduction section 211, and extends so as to separate from the second side seal section 22. From the lower end of this intermediate section 212, the expulsion section 213 is extended toward the second side seal section 22. Also in this example, like the foregoing embodiment, the passage extension section 31 is defined by the outlet 2*b* of the air passage 2, the downward flow side edges 11*b* and 12*b* of the valve films 11 and 12, and a virtual line 21*c*. This virtual line 21*c* links the downward flow side end section 21*b* of the first side seal section 21 and the downward flow side edges 11*b* and 12*b* of the valve films 11 and 12, and the valve films 11 and 12 are not bonded together at this virtual line 21*c*, and air in the air passage 2 flows out of the valve films 11 and 12 through the passage extension section 31 from the outlet 2*b*. In FIG. 10(D), the virtual line 21*c* does not coincide with a line of extension of the second side seal section 22, but as shown in FIG. 10(E), by shortening the expulsion section 213, the virtual line 21*c* and the line of extension may also be made to coincide with each other. Further, the front end of the expulsion section 213 may be located on the line of extension. Either in the embodiment of FIG. 10(D) or in the embodiment of FIG. 10(E), the free section 32 is formed lateral to the second side seal section 22.

Figure 11:
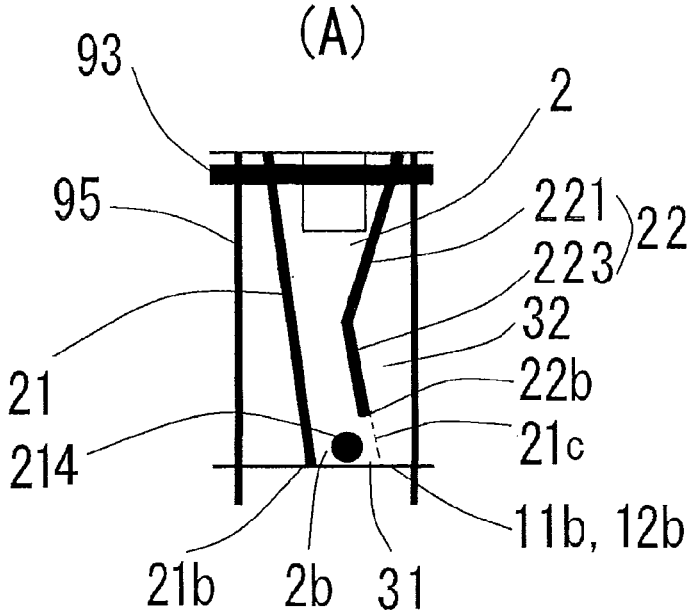
FIGS. 11(A) and 11(B) are schematic plan views showing still other embodiments of a check valve relating to the present invention.
Figure 11:
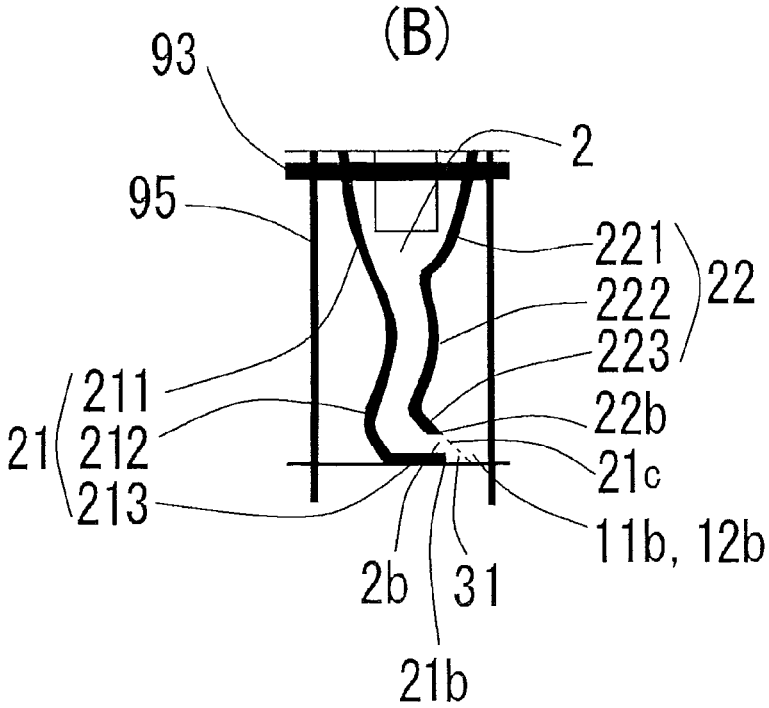

Next, description will be given of still another embodiment with reference to FIG. 11(A). In this embodiment, the first side seal section 21 and an introduction section 221 on the upward flow side of the second side seal section 22 are formed inclined, in such a manner that these mutually approach from the upward flow side toward the downward flow side. However, the second side seal section 22 is bent in an introduction section 223 on the downward flow side thereof, and extends so as to be in parallel with the first side seal section 21. In this embodiment, a point seal 214 is formed in the vicinity of the outlet 2*b* of the air passage 2 (that is, a line linking the downward flow side end section 21*b* of the first side seal section 21 and the downward flow side end section 22*b* of the second side seal section 22). This point seal 214 is formed by bonding the upper and lower valve films together, and like the expulsion section 213 in the foregoing embodiment, prevents inverse flow of air from the storage section 62 from directly entering the air passage 2 to improve the effect to prevent inverse flow of the check valve 1.

Also in this example, like the foregoing embodiment, the passage extension section 31 is defined by the outlet 2*b* of the air passage 2, the downward flow side edges 11*b* and 12*b* of the valve films 11 and 12, and a virtual line 21*c*. This virtual line 21*c* coincides with a line of extension of the second side seal section 22. Also in this embodiment, the free section 32 is formed lateral to the second side seal section 22.

Next, description will be given of still another embodiment with reference to FIG. 11(B). In this embodiment, the introduction section 211 of the first side seal section 21 and the introduction section 221 of the second side seal section 22 are formed curved, in such a manner that these mutually approach from the upward flow side toward the downward flow side. However, the first side seal section 21, in the intermediate section 212 thereof, curves in an arch form. The intermediate section 222 of the second side seal section 22 also curves along the intermediate section 212 to form a meandering air passage 2. From the lower end of this intermediate section 212 of the first side seal section 21, the expulsion section 213 is extended in the lateral direction toward the second side seal section 22. The introduction section 223 on the lower end of the second side seal section 22 is extended along a lower half of the intermediate section 212 of the first side seal section 21.

Also in this example, like the foregoing embodiment, the passage extension section 31 is defined by the outlet 2*b* of the air passage 2, the downward flow side edges 11*b* and 12*b* of the valve films 11 and 12, and a virtual line 21*c*. This virtual line 21*c* links the downward flow side end section 21*b* of the first side seal section 21 and the downward flow side edges 11*b* and 12*b* of the valve films 11 and 12, and the valve films 11 and 12 are not bonded together at this virtual line 21*c*, and air in the air passage 2 flows out of the valve films 11 and 12 through the passage extension section 31 from the outlet 2*b*. In FIG. 11(B), the virtual line 21*c* coincides with a line of extension of the second side seal section 22. The free section 32 is formed lateral to the second side seal section 22.

What is claimed is:

1. A check valve comprising two valve films of synthetic resin that are placed one on the other and bonded at parts thereof together, thereby forming an air passage that allows to pass air through the valve films from an inlet to an outlet, the air passage being closable by the valve films that closely contact together, wherein the air passage is defined by two seal sections, comprising a first side seal section and a second side seal section, formed by bonding the valve films together, the inlet of the air passage being defined by a straight line linking respective upward flow side end sections of the seal sections, while the outlet of the air passage being defined by a straight line linking respective downward flow side end sections of the seal sections, and at least the downward flow side end sections of the second side seal section of the two seal sections, and downward flow side edges of the valve films are separated, wherein a passage extension section is provided on the downward flow side of the air passage, the passage extension section being defined by the outlet of the air passage, the downward flow side edges of the valve films, and a virtual line, the virtual line linking at least the downward flow side end section of the second side seal section of the two seal sections, and the downward flow side edges of the valve films, and at the virtual line, the valve films are not bonded together, and air in the air passage flows out of the valve films through the passage extension section from the outlet, wherein the check valve further comprises a non-sealed section comprising the passage extension section and a free section, the free section being adjacent to the passage extension section or to the air passage and the passage extension section, the passage extension section and the free section being bounded by the line of extension that defines the passage extension section, wherein the portions of valve film constituting the passage extension section and the free section form a single body, wherein the first side seal section is provided with an introduction section on the upward flow side and an expulsion section on the downward flow side, the expulsion section being extended in a lateral direction so as to approach to the second side seal section, and the expulsion section is formed at a front edge of the first side seal section and prevents an inverse flow of air from entering the air passage, wherein the second side seal section is provided with three sections that are an introduction section, an intermediate section, and an expulsion section, the intermediate section connecting between the introduction section and the expulsion section, and wherein, regarding the second side seal section, the intermediate section is formed closer to the first side seal section than the introduction section, further the expulsion section being formed closer to the first side seal section than the intermediate section, wherein the inlet of the air passage is defined by the upward flow side end section of the introduction section and the upward flow side end section of the first side seal section, while the outlet of the air passage is defined by the downward flow side end section of the introduction section and the downward flow side end section of the first side seal section, and wherein the downward flow side end section of the second side seal section is formed further towards the upward flow side than the downward flow side end section of the first side seal section.

2. The check valve according to claim 1, wherein the virtual line is a line of extension where the second seal section is extended toward the downward flow side edges of the valve films.

3. The check valve according to claim 2, wherein a slit is formed in each of the two valve films, the slit following the air passage and the passage extension section, and being formed in such a manner that the downward flow side edges of the valve films are divided.

4. The check valve according to claim 2, wherein the dimension between the respective end sections of the first side seal section and the second side seal section at the outlet of the air passage is smaller than the dimension between the respective end sections at the inlet of the air passage.

5. The check valve according to claim 2, wherein, in the air passage, the upward flow side edge of the valve films that are placed one on another, and the upward flow side edge of the other of the valve films are disposed at least respectively in staggered positions towards the upward flow side and the downward flow side.

6. The check valve according to claim 2, wherein an inert liquid is disposed on at least part of the inner surfaces of the valve films in the air passage.

7. The check valve according to claim 1, wherein a slit is formed in each of the two valve films, the slit following the air passage and the passage extension section, and being formed in such a manner that the downward flow side edges of the valve films are divided.

8. The check valve according to claim 1, wherein the dimension between the respective end sections of the first side seal section and the second side seal section at the outlet of the air passage is smaller than the dimension between the respective end sections at the inlet of the air passage.

9. The check valve according to claim 1, wherein, in the air passage, the upward flow side edge of the valve films that are placed one on another, and the upward flow side edge of the other of the valve films are disposed at least respectively in staggered positions towards the upward flow side and the downward flow side.

10. The check valve according to claim 1, wherein an inert liquid is disposed on at least part of the inner surfaces of the valve films in the air passage.

11. A compression bag equipped with a check valve, being a compression bag formed with at least two bag films of synthetic resin that are placed one on the other and bonded at parts thereof together, thereby comprising a storage section provided with an opening, the storage section being able to contain an item for storage, and a deaeration opening for removing air in the storage section other than the opening, wherein the respective bag films have a rectangular shape in a plan view, and the opening is provided in the upper part of the compression bag and is hermetically closable by a closing device, while the deaeration opening is provided in the lower part of the compression bag, wherein a check valve according to claim 1 is installed between the storage section and the deaeration opening with the inlet side of the air passage towards the top and the outlet side towards the bottom, the installation of the check valve being achieved by forming a unifying seal section where the valve films and the bag films are bonded together, air being prevented from flowing between the storage section and the deaeration opening except through the air passage, wherein a heat resistant coating is disposed on at least part of the inner surfaces of the valve films in the air passage, the part being taken in a portion that coincides with the unifying seal section.

12. The compression bag equipped with a check valve according to claim 11, wherein elongate films are used for the valve films and a plurality of the check valves are disposed parallel in the lengthwise direction of the valve films in such a manner that the air passages and free sections are respectively adjacent.

13. An air cushion bag, being an air cushion bag formed with at least two bag films of synthetic resin that are placed one on the other and bonded at parts thereof together, thereby comprising an air filling section being able to be filled with air, and an air injection port for injecting air into the air filling section, wherein the respective bag films have a rectangular shape in a plan view, and the air injection port is provided in the upper part of the air cushion bag, wherein a check valve according to claim 1 is installed between the air filling section and the air injection port with the inlet side of the air passage towards the top and the outlet side towards the bottom, the installation of the check valve being achieved by forming a unifying seal section where the valve films and the bag films are bonded together, air being prevented from flowing between the air filling section and the air injection port except through the air passage, wherein a heat resistant coating is disposed on at least part of the inner surfaces of the valve films in the air passage, the part being taken in a portion that coincides with the unifying seal section.

14. The air cushion bag according to claim 13, wherein elongate films are used for the valve films and a plurality of the check valves are disposed parallel in the lengthwise direction of the valve films in such a manner that the air passages and free sections are respectively adjacent.

15. The air cushion bag according to claim 14, wherein a plurality of air filling sections are formed in parallel, and one check valve is provided per each air filling section.

* * * * *